US008947309B2

(12) United States Patent
Hamabe

(10) Patent No.: US 8,947,309 B2
(45) Date of Patent: Feb. 3, 2015

(54) ANTENNA DEVICE AND DISPLAY DEVICE

(75) Inventor: Taichi Hamabe, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 327 days.

(21) Appl. No.: 13/537,881

(22) Filed: Jun. 29, 2012

(65) Prior Publication Data

US 2012/0262351 A1 Oct. 18, 2012

Related U.S. Application Data

(63) Continuation of application No. PCT/JP2011/003268, filed on Jun. 9, 2011.

(30) Foreign Application Priority Data

Jun. 10, 2010 (JP) ..... 2010-132684

(51) Int. Cl.
*H01Q 21/30* (2006.01)
*H01Q 19/24* (2006.01)
*H01Q 1/24* (2006.01)
(Continued)

(52) U.S. Cl.
CPC ..... *H01Q 19/24* (2013.01); *H01Q 1/241* (2013.01); *H01Q 9/26* (2013.01); *H01Q 9/42* (2013.01); *H01Q 21/28* (2013.01); *H01Q 25/00* (2013.01)
USPC ..... 343/727; 343/795; 343/803; 343/806

(58) Field of Classification Search
CPC ..... H01Q 19/24; H01Q 1/241; H01Q 21/28; H01Q 9/26; H01Q 9/42
USPC ..... 343/702, 725, 726, 727, 803, 805, 795, 343/806
See application file for complete search history.

(56) References Cited

U.S. PATENT DOCUMENTS 5,598,169 A * 1/1997 Drabeck et al. ..... 343/701
5,684,491 A 11/1997 Newman et al.
(Continued)

FOREIGN PATENT DOCUMENTS

CN 1669182 A 9/2005
CN 2919568 Y 7/2007
(Continued)

OTHER PUBLICATIONS

Search Report issued in Chinese Application No. 201180013951.7.
(Continued)

*Primary Examiner* — Tho G Phan
(74) *Attorney, Agent, or Firm* — McDermott Will & Emery LLP

(57) ABSTRACT

An antenna device, in which a dipole antenna (110), a first monopole antenna, and a second monopole antenna are disposed on an insulating board (140), wherein the dipole antenna (110) includes left and right elements connected to a power feeding section (150), and the left and right elements have: first portions extended from the power feeding section in a state of facing each other; and second portions extended from the first portions separately to left and right sides, and the first monopole antenna (120) connects to the power feeding section and extends toward the second portion of the left element in the dipole antenna (110), and the second monopole antenna (130) connects to the power feeding section (150) and extended toward the second portion of the right element of the dipole antenna (110).

8 Claims, 6 Drawing Sheets

(51) Int. Cl.

| | |
|---|---|
| ***H01Q 9/26*** | (2006.01) |
| ***H01Q 9/42*** | (2006.01) |
| ***H01Q 21/28*** | (2006.01) |
| ***H01Q 25/00*** | (2006.01) |

(56) References Cited

U.S. PATENT DOCUMENTS

| | | | | |
|---|---|---|---|---|
| 5,907,816 | A | 5/1999 | Newman et al. | |
| 6,329,954 | B1 | 12/2001 | Fuchs et al. | |
| 6,362,784 | B1 * | 3/2002 | Kane et al. | 343/700 MS |
| 7,119,745 | B2 * | 10/2006 | Gaucher et al. | 343/700 MS |
| 7,315,289 | B2 * | 1/2008 | Puente Baliarda et al. | 343/817 |
| 7,724,201 | B2 * | 5/2010 | Nysen et al. | 343/821 |
| 2005/0195124 | A1 | 9/2005 | Puente Baliarda et al. | |
| 2008/0129630 | A1 | 6/2008 | Baliarda et al. | |
| 2009/0051619 | A1 | 2/2009 | Hook et al. | |
| 2013/0002497 | A1 | 1/2013 | Hamabe | |

FOREIGN PATENT DOCUMENTS

| | | | |
|---|---|---|---|
| CN | 102804496 | A | 11/2012 |
| EP | 1 603 189 | A1 | 12/2005 |
| JP | 2000-503819 | | 3/2000 |
| JP | 2003-531545 | | 10/2003 |
| JP | 2005-347882 | | 12/2005 |
| JP | 3121551 | | 4/2006 |
| JP | 3121551 | U | 4/2006 |
| JP | 2007-281906 | | 10/2007 |
| JP | 2008-124865 | | 5/2008 |
| JP | 2010-010990 | | 1/2010 |
| WO | WO 96/23329 | | 8/1996 |
| WO | WO 01/80366 | A1 | 10/2001 |
| WO | WO 2007-073266 | A1 | 6/2007 |

OTHER PUBLICATIONS

International Search Report issued in International Patent Application No. PCT/JP2011/003268dated Sep. 13, 2011.

English translation of Chinese Search Report issued in corresponding Chinese Application No. 201180013951.7, dated Jun. 6, 2014.

* cited by examiner

ANTENNA DEVICE AND DISPLAY DEVICE

RELATED APPLICATUON

This application is a continuation of PCT International Application PCT/JP2011/003268 filed on Jun. 9, 2011, which claims priority to Japanese Patent Application No. 2010-132684 filed on Jun. 10, 2010. The disclosures of these applications including the specifications, the drawings, and the claims are hereby incorporated by reference in their entirety.

TECHNICAL FIELD

The instant application relates to an antenna device having a plurality of antennas, and to a display device including an antenna device.

BACKGROUND ART

Portable display devices have been being widespread, which are capable of receiving terrestrial digital broadcasting and the like. In each of these display devices, it is necessary to mount an antenna for receiving airwaves inside or outside of a cabinet composing the portable display device. In particular, to achieve a high-sensitivity reception of the airwaves, a diversity method, in which a plurality of antennas are provided, is used.

Moreover, the plurality of antennas may take various different shapes and mounting arrangement on the device. (for example, refer to PTLs 1 to 3).

CITATION LIST

Patent Literature

PTL 1: Unexamined Japanese Patent Publication No. 2005-347882

PTL 2: Unexamined Japanese Patent Publication No. 2007-281906

PTL 3: Unexamined Japanese Patent Publication No. 2008-124865

SUMMARY

In one general aspect, the instant application describes an antenna device, including: an insulating board; a dipole antenna; a first monopole antenna; and a second monopole antenna, these antennas being disposed on the insulating board, wherein the dipole antenna includes left and right elements connected to a power feeding section, and the left and right elements have first portions extended from the power feeding section in a state of facing each other, and second portions extended from the first portions separately to left and right sides; the first monopole antenna is connected to the power feeding section, and is disposed to be extended toward the second portion of the left element in the dipole antenna; and the second monopole antenna is connected to the power feeding section, and is disposed to be extended toward the second portion of the right element in the dipole antenna.

In accordance with the instant application, an antenna device can be provided, which is capable of arranging a plurality of antennas having the same frequency band close to one another in a loosely coupling manner, and moreover, a display device including the antenna device can be provided.

DESCRIPTION OF EMBODIMENTS

A description is made of a display device having an antenna device according to an exemplary embodiment with reference to the drawings.

Figure 1A:
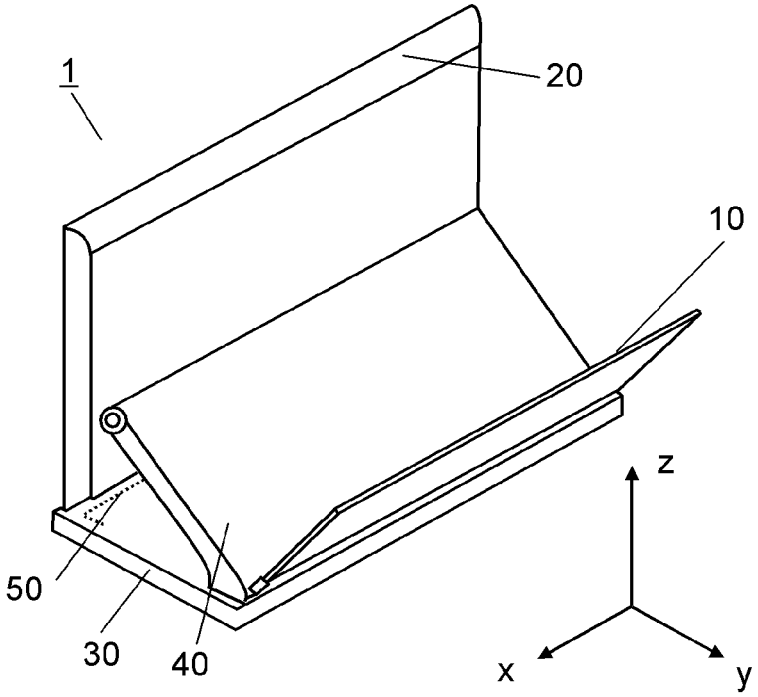
FIG. 1A is a perspective view of an exterior appearance of a display device.
Figure 1B:
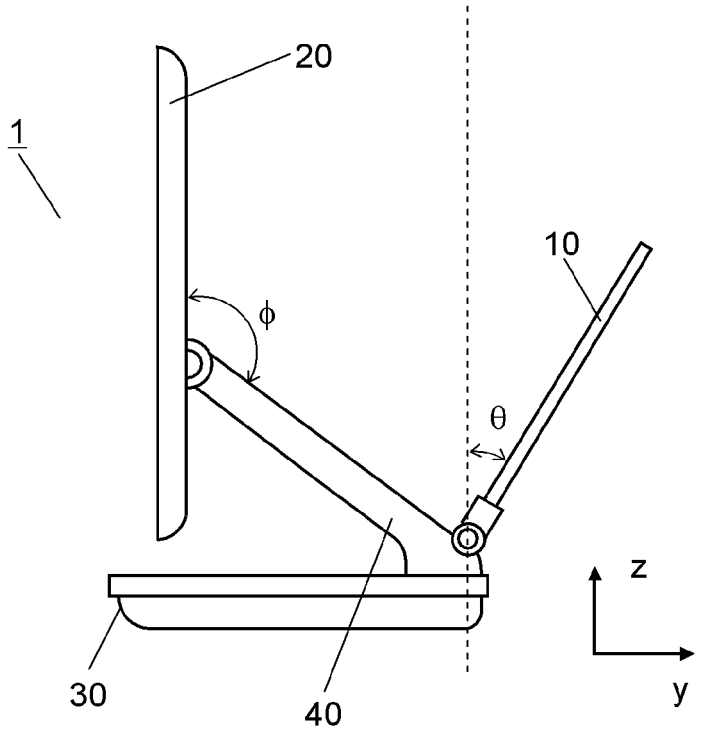
FIG. 1B is a side view of the display device.

First, a description is made of a configuration of a display device 1 according to this exemplary embodiment. FIG. 1A is a perspective view showing an exterior appearance of the display device 1. FIG. 1B is a side view of the display device 1.

The display device 1 includes: an antenna device 10; a liquid crystal display (LCD) 20 as a display; a main body 30 housing a variety of electric circuits, a support member 40; and a front antenna 50. Note that, in this exemplary embodiment, a horizontal direction of an image display screen of the LCD 20 is defined as an x-axis, a vertical direction of the display device 1 is defined as a z-axis, and a direction perpendicular to the x-axis and the z-axis is defined as a y-axis. Moreover, a right orientation of the image display surface of the LCD 20 when viewed from the front is defined as a positive orientation of the x-axis, and a left orientation of the image display surface thereof when viewed from the front is defined as a negative orientation of the x-axis. Moreover, an upward orientation of the display device 1 in the vertical direction (an upward orientation perpendicular to a mounting surface of the main body 30) is defined as a positive orientation of the z-axis, and a lower orientation thereof in the vertical direction is defined as a negative orientation of the z-axis. Furthermore, an orientation of the LCD 20 on an image display surface side is defined as a negative orientation of the y-axis, and an orientation thereof on a side opposite to the image display surface is defined as a positive orientation of the y-axis.

The LCD 20 has the image display surface in the negative orientation of the y-axis, and displays a video. The LCD 20 has a metal frame (not shown) that surrounds the image display surface from a back surface side. The LCD 20 is located in the vicinity of one end portion (left end portion in FIG. 1B) on a rectangular upper surface of the main body 30. Note that, the LCD 20 is an example of a display. For example, an organic EL display and the like may be used.

The main body 30 includes an exterior cabinet. The exterior cabinet may be made of a resin material. In the exterior cabinet, the main body 30 may house an electric circuit board (not shown) including a tuner circuit that receives terrestrial digital broadcasting signal and the like. The main body 30 transfers an electric signal, which may be received by the antenna device 10, to a tuner circuit (not shown), and may take out desired video data. The main body 30 sends the taken-out video data to the LCD 20, and allows the LCD 20 to display an image. Besides this, the main body 30 has, in the exterior cabinet, a power supply circuit and an audio circuit, a recording device and a playback device, and further, a heat radiating metal member for reducing heat generated in the electric circuit board and the like (any not shown).

Figure 2:
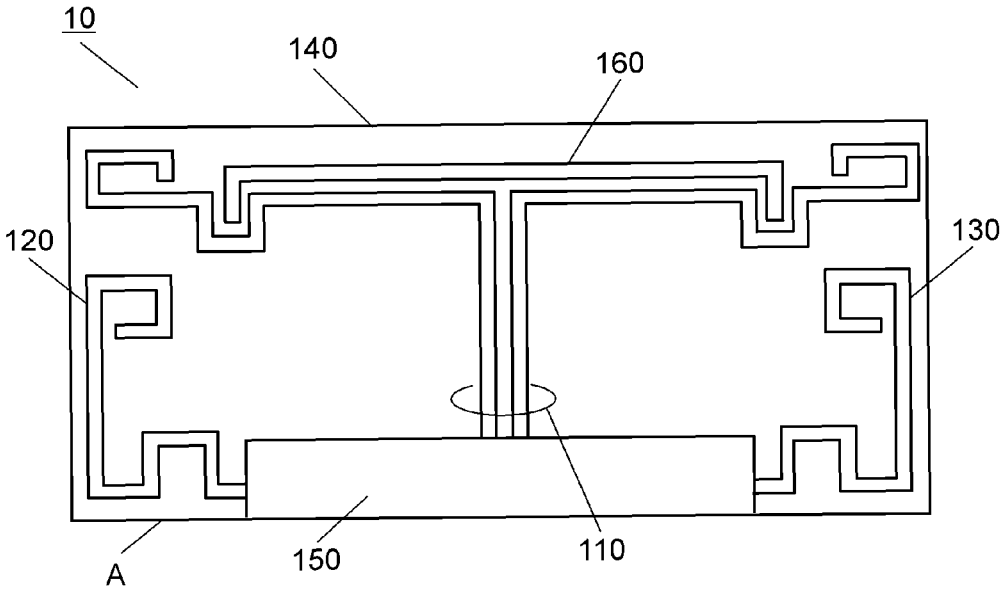
FIG. 2 is a view showing a configuration of an antenna device.

The support member 40 may be made of a resin material. On the upper surface of the main body 30, the support member 40 is fixed to the main body 30 at an end portion thereof opposite with the end portion above which the LCD 20 is located. Moreover, the support member 40 supports a back surface of the LCD 20 on an opposite side thereof with a side connected to the main body 30. The LCD 20 is rotatable on a y-z plane about, as a fulcrum, a connection portion thereof to the support member 40. That is, the LCD 20 is rotatable in a $\phi$ direction of FIG. 1B. In such a way, a viewer can appropriately adjust a viewing angle in an upper and lower direction. As shown in FIG. 1A, FIG. 1B and FIG. 2, the antenna device 10 includes a configuration in which a plurality of antennas are disposed on a single insulating board 140, and may be substantially rectangular plate shape. The antenna device 10 includes a power feeding section 150, to which power feeding ends of the respective antennas are connected, on one end side portion of the rectangular shape. The antenna device 10 is attached so that support end A (see FIG. 2) as a side on which the power feeding section 150 is provided can face the upper surface of the main body 30. In this exemplary embodiment, the antenna device 10 is supported so as to be rotatably erected in the vicinity of one end portion on the substantially rectangular upper surface of the main body 30. More specifically, the antenna device 10 is rotatable on the y-z plane about such a support portion as a fulcrum. In such a way, the viewer can appropriately adjust an orientation of the antenna device 10. Note that, as shown in FIG. 1B, in this exemplary embodiment, the antenna device 10 is attached onto the support member 40; however, the antenna device 10 may be directly attached onto the upper surface of the main body 30 if such an attached place is the vicinity of one end portion of the substantially rectangular upper surface of the main body 30.

In the display device 1 of this exemplary embodiment, at the time when the display device 1 is used, a radio wave can be preferably received when the antenna device 10 is rotated in a substantially vertical direction (a position, where $\theta$ of FIG. 1B is equal to 0 degree ($\theta$=0°), is the vertical direction). At this time, the image display surface of the LCD 20 faces a side opposite to the antenna device 10. Moreover, the LCD 20 is supported so as to be located, on the upper surface of the main body 30, in the vicinity of an end portion thereof opposite with the end portion on which the antenna device 10 is supported.

Next, a description is made in detail of the configuration of the antenna device 10 with reference to FIG. 2. FIG. 2 is a view showing the configuration of the antenna device 10. Note that, in the following, the description is made on the assumption that a principal surface of the antenna device 10 is located in an orientation parallel to an x-z plane ($\theta$=0° in FIG. 1B) for the sake of convenience.

The antenna device 10 includes: a dipole antenna 110; a first monopole antenna 120; a second monopole antenna 130; an insulating board 140 made of acrylic resin or the like; the power feeding section 150; a passive element 160. The respective power feeding ends of the dipole antenna 110, the first monopole antenna 120, and the second monopole antenna 130 are connected to the power feeding section 150. As a method of connecting the respective antennas and the power feeding section 150 to each other, for example, the power feeding ends of the respective antennas and terminals of the power feeding section 150 just need to be connected to each other by springs and the like. In this exemplary embodiment, a width of each antenna element is constant at 3 mm.

On a surface of the board 140, the dipole antenna 110, the first monopole antenna 120, and the second monopole antenna 130 are formed of patterns of metal such as copper. The dipole antenna 110, the first monopole antenna 120, and the second monopole antenna 130 can be formed, for example, by printing of the metal patterns, pasting of metal films, pasting of metal lines, etching of metal or the like. A base portion of the board 140 is made, for example, of an acrylic material.

In this exemplary embodiment, an outer shape of the board 140 is a substantially rectangular shape with a dimension of 220 mm×105 mm, and the board 140 includes a recessed portion at which the power feeding section 150 is located. The power feeding section 150 may be provided integrally with the board 140. The dipole antenna 110, the first monopole antenna 120, and the second monopole antenna 130, which are mentioned above, are formed within a surface of such a substantial rectangle.

Figure 3:
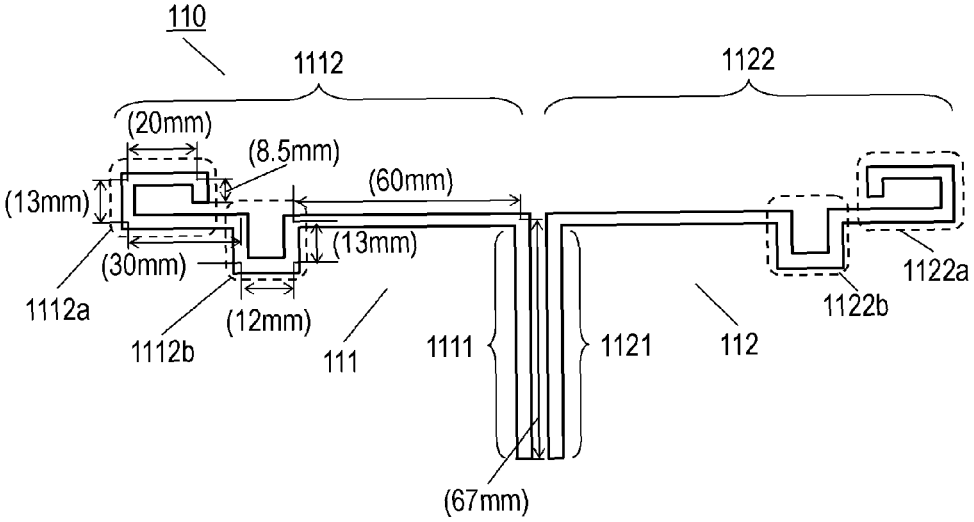
FIG. 3 is a view showing a configuration of a dipole antenna.

FIG. 3 is a view showing a detailed configuration of the dipole antenna 110. The dipole antenna 110 includes a first element 111 (left element) and a second element 112 (right element). The dipole antenna 110 is an antenna that sets therein a terrestrial digital broadcasting band (473 MHz to 767 MHz) as a desired service band. The dipole antenna 110 includes a first portions 1111 and 1121 extended from the power feeding section 150 in a state where the first element 111 and the second element 112 face each other. In this exemplary embodiment, the dipole antenna 110 includes the first portions 1111 and 1121 in which the respective elements are extended in parallel to each other in a lateral direction (first direction) of the board 140 from the power feeding ends connected to the power feeding section 150. Moreover, the dipole antenna 110 includes a second portions 1112 and 1122 in which the first element 111 and the second element 112 are extended from the first portions 1111 and 1121 separately to left and right sides, respectively. In this exemplary embodiment, the dipole antenna 110 includes the second portions 1112 and 1122 in which the respective elements are extended reverse to each other in a longitudinal direction (second direction) of the board 140 from end portions of the first portions 1111 and 1121. Note that "extended in the lateral direction" or "extended in the longitudinal direction" indicates a direction in which the respective elements are mainly extended, and includes the case where the respective elements are partially bent.

The first portion 1111 of the first element 111 connects with the second portion 1112 of the first element 111 at a 90 degrees angle. Moreover, the first portion 1121 of the second element 112 connects the second portion 1122 of the second element 112 at a 90 degrees angle The first portion 1111 of the first element 111 and the first portion 1121 of the second element 112 are disposed parallel to each other. In this exemplary embodiment, the first portion 1111 of the first element 111 is 67 mm. Moreover, the first portion 1121 of the second element 112 is 67 mm.

The second portion 1112 of the first element 111 includes a bent portion 1112*b* at some midpoint therein. Moreover, the second portion 1112 of first element 111 includes an entangled portion 1112*a* on a tip portion thereof.

First, a description is made of the bent portion 1112*b*. The second portion 1112 of the first element 111 is extended by 60 mm in the positive direction of the x-axis from a contact point between the first portion 1111 and the second portion 1112, and is bent by 90 degrees to the power feeding section 150 side (negative orientation of the z-axis). The bent portion 1112*b* is extended by 13 mm from such a bent point, and is bent by 90 degrees in the positive orientation of the x-axis. Then, the bent portion 1112*b* is extended by 12 mm in the positive orientation of the x-axis, and is bent by 90 degrees to a reverse side (positive orientation of the z-axis) to the power feeding section 150. Then, the bent portion 1112*b* is extended by 13 mm in the positive orientation of the z-axis, and is bent by 90 degrees in the positive orientation of the x-axis.

Next, a description is made of the entangled portion 1112*a*. The second portion 1112 of the first element 111 is extended by 30 mm in the positive orientation of the x-axis from an end portion of the bent portion 1112*b*, and is bent by 90 degrees to the reverse side (positive orientation of the z-axis) to the power feeding section 150. The entangled portion 1112*a* is extended by 13 mm from such a bent point, and is bent by 90 degrees in the negative orientation of the x-axis. Then, the entangled portion 1112*a* is extended by 20 mm in the negative orientation of the x-axis, and is bent by 90 degrees to the power feeding section 150 side (negative orientation of the z-axis). Then, the entangled portion 1112*a* is extended by 8.5 mm in the negative orientation of the z-axis.

The second portion 1122 of the second element 112 includes a bent portion 1122*b* at some midpoint therein. Moreover, the second portion 1122 of the second element 112 includes an entangled portion 1122*a* on a tip portion thereof.

A description is made of the bent portion 1122*b*. The second portion 1122 of the second element 112 is extended by 60 mm in the negative direction of the x-axis from a contact point between the first portion 1121 and the second portion 1122, and is bent by 90 degrees to the power feeding section 150 side (negative orientation of the z-axis). The bent portion 1122*b* is extended by 13 mm from such a bent point, and is bent by 90 degrees in the negative orientation of the x-axis. Then, the bent portion 1122*b* is extended by 12 mm in the negative orientation of the x-axis, and is bent by 90 degrees to the reverse side (positive orientation of the z-axis) to the power feeding section 150. Then, the bent portion 1122*b* is extended by 13 mm in the positive orientation of the z-axis, and is bent by 90 degrees in the negative orientation of the x-axis.

Next, a description is made of the entangled portion 1122*a*. The second portion 1122 of the second element 112 is extended by 30 mm in the negative orientation of the x-axis from an end portion of the bent portion 1122*b*, and is bent by 90 degrees to the reverse side (positive orientation of the z-axis) to the power feeding section 150. The entangled portion 1122*a* is extended by 13 mm from such a bent point, and is bent by 90 degrees in the positive orientation of the x-axis. Then, the entangled portion 1122*a* is extended by 20 mm in the positive orientation of the x-axis, and is bent by 90 degrees to the power feeding section 150 side (negative orientation of the z-axis). Then, the entangled portion 1122*a* is extended by 8.5 mm in the negative orientation of the z-axis.

Figure 4:
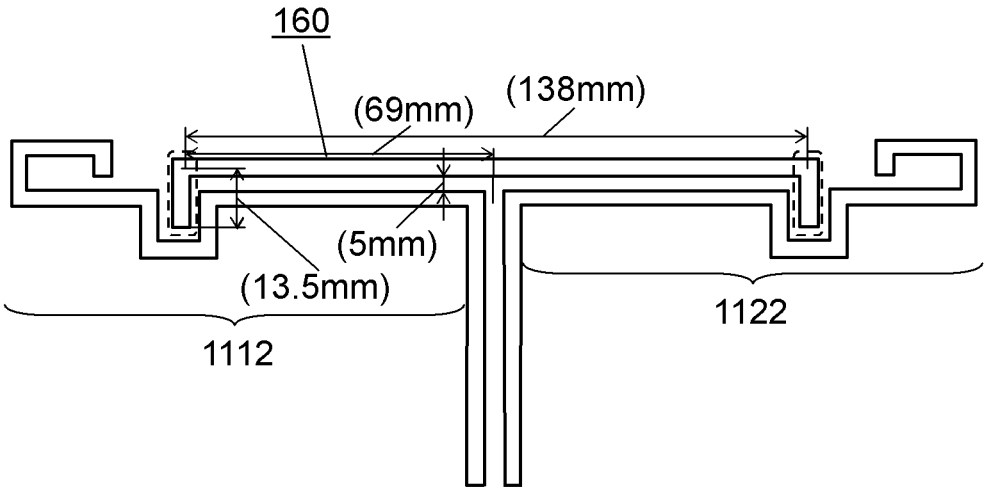
FIG. 4 is a view showing a configuration of a passive element.

FIG. 4 is a view showing a configuration of the passive element 160. The passive element 160 is formed on the board 140, and is provided in the second direction so as to be parallel to the second portions 1112 and 1122 of the dipole antenna 110. The passive element 160 is located at a position apart by 5 mm in the positive orientation of the z-axis from a tip of the first portion 1111 of the first element 111 and a tip of the first portion 1121 of the second element 112. Both ends of the passive element 160 are bent to the power feeding section 150 side (negative orientation of the z-axis).

Specifically, one of the ends is bent by 90 degrees at a position apart by 69 mm in the positive orientation of the x-axis from a center of the passive element 160, and is extended by 13.5 mm. Moreover, the other of the ends is bent by 90 degrees at a position apart by 69 mm in the negative orientation of the x-axis from the center of the passive element 160, and is extended by 13.5 mm.

Figure 5A:
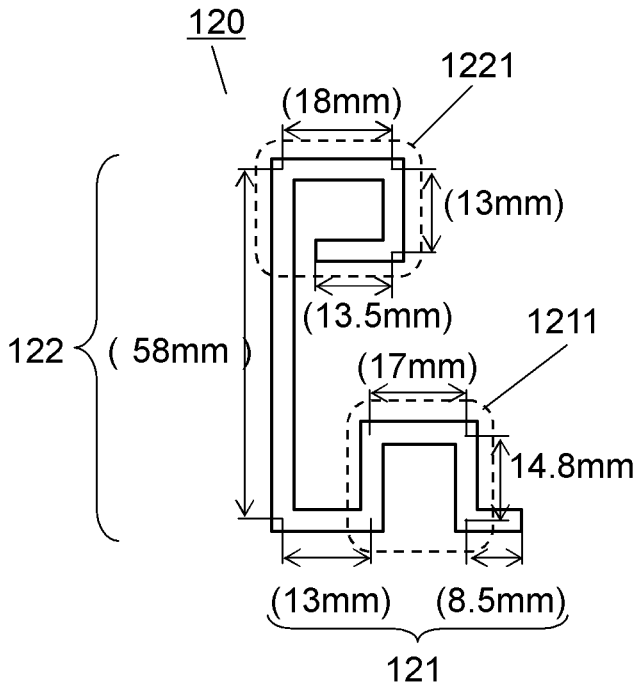
FIG. 5A is a view showing a configuration of a first monopole antenna.
Figure 5B:
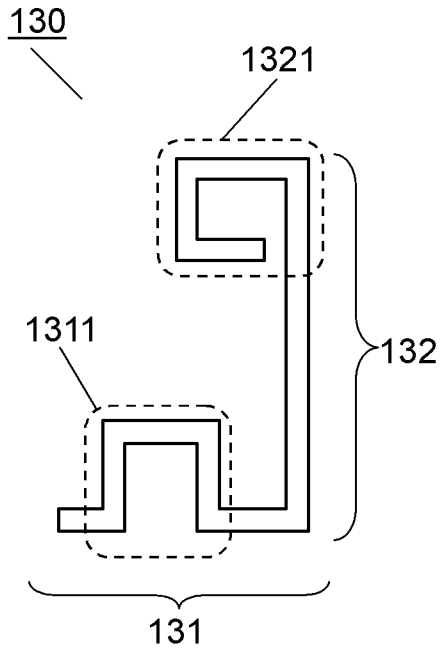
FIG. 5B is a view showing a configuration of a second monopole antenna.

FIG. 5A is a view showing a configuration of the first monopole antenna 120. FIG. 5B is a view showing a configuration of the second monopole antenna 130.

The first monopole antenna 120 is extended from the power feeding section 150. The first monopole antenna 120 is disposed toward the second portion 1112 of the first element 111 in the dipole antenna 110. The first monopole antenna 120 includes a first portion 121 and a second portion 122. Then, the first portion 121 of the first monopole antenna 120 includes a bent portion 1211 at some midpoint thereof. The first portion 121 of the first monopole antenna 120 is extended by 8.5 mm in the positive direction of the x-axis from the power feeding section 150, and is bent by 90 degrees in the positive direction of the z-axis. The bent portion 1211 is extended by 14.8 mm in the positive direction of the z-axis from such a bent point, and is bent by 90 degrees in the positive direction of the x-axis. Then, the bent portion 1211 is extended by 17 mm in the positive direction of the x-axis, and is bent by 90 degrees in the negative direction of the z-axis. Then, the bent portion 1211 is extended by 14.8 mm in the negative direction of the z-axis, and is bent by 90 degrees in the positive direction of the x-axis. The first position 121 extends a tip, which is from a terminal end of a bent portion 1211, by 13 mm in the positive direction of the x-axis.

The second portion 122 of the first monopole antenna 120 includes an entangled portion 1221 at a tip portion thereof. The second portion 122 of the first monopole antenna 120 is extended by 58 mm in the positive direction of the z-axis from a tip of the first portion 121, and is bent by 90 degrees in the negative direction of the x-axis. The entangled portion 1221 is extended by 18 mm in the negative direction of the x-axis from such a bent point, and is bent by 90 degrees in the negative direction of the z-axis. Then, the entangled portion 1221 is extended by 13 mm in the negative direction of the z-axis, and is bent by 90 degrees in the positive direction of the x-axis. Then, the entangled portion 1221 is extended by 13.5 mm in the positive direction of the x-axis.

The second monopole antenna 130 is extended from the power feeding section 150. The second monopole antenna 130 is disposed toward the second portion 1122 of the second element 112 in the dipole antenna 110. The second monopole antenna 130 includes a first portion 131 and a second portion 132. Then, the first portion 131 of the second monopole antenna 130 includes a bent portion 1311 at some midpoint thereof. The first portion 131 of the second monopole antenna 130 is extended by 8.5 mm in the negative direction of the x-axis from the power feeding section 150, and is bent by 90 degrees in the positive direction of the z-axis. The bent portion 1311 is extended by 14.8 mm in the positive direction of the z-axis from such a bent point, and is bent by 90 degrees in the negative direction of the x-axis. Then, the bent portion 1311 is extended by 17 mm in the negative direction of the x-axis, and is bent by 90 degrees in the negative direction of the z-axis. Then, the bent portion 1311 is extended by 14.8 mm in the negative direction of the z-axis, and is bent by 90 degrees in the negative direction of the x-axis. The first position 131 extends a tip, which is from a terminal end of the bent portion 1311, by 13 mm in the negative direction of the x-axis.

The second portion 132 of the second monopole antenna 130 includes an entangled portion 1321 at a tip portion thereof. The second portion 132 of the second monopole antenna 130 is extended by 58 mm in the positive direction of the z-axis from a tip of the first portion 131, and is bent by 90 degrees in the positive direction of the x-axis. The entangled portion 1321 is extended by 18 mm in the positive direction of the x-axis from such a bent point, and is bent by 90 degrees in the negative direction of the z-axis. Then, the entangled portion 1321 is extended by 13 mm in the negative direction of the z-axis, and is bent by 90 degrees in the negative direction of the x-axis. Then, the entangled portion 1321 is extended by 13.5 mm in the negative direction of the x-axis.

Figure 6:
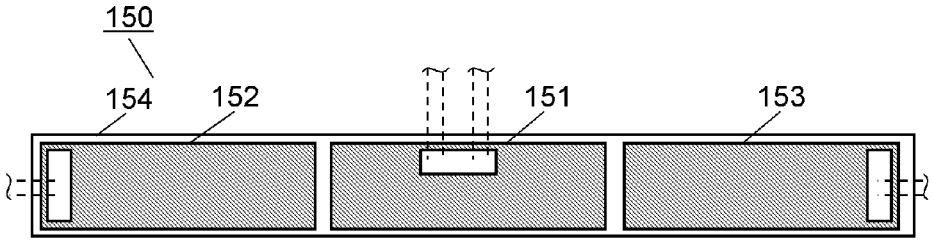
FIG. 6 is a view showing a configuration of a power feeding section.

Next, a description is made of the power feeding section 150 with reference to FIG. 6. FIG. 6 is a schematic view showing a configuration of the power feeding section 150.

The power feeding section 150 is formed of a double-layer board, which is single and includes a conductive layer and a dielectric layer 154. In the power feeding section 150, there are packaged a matching circuit and a low noise amplifier (LNA) circuit (not shown). Moreover, to the power feeding section 150, there are connected the respective power feeding ends of the dipole antenna 110, the first monopole antenna 120, and the second monopole antenna 130. In the conductive layer, the power feeding section 150 includes: a ground area 151 corresponding to the dipole antenna 110; a ground area 152 corresponding to the first monopole antenna 120; and a ground area 153 corresponding to the second monopole antenna 130. The ground areas 151 to 153 are conductive patterns which apply electrical ground potentials to the respective antennas. In the power feeding section 150, the ground areas 151 to 153 are separated from one another.

Figure 7:
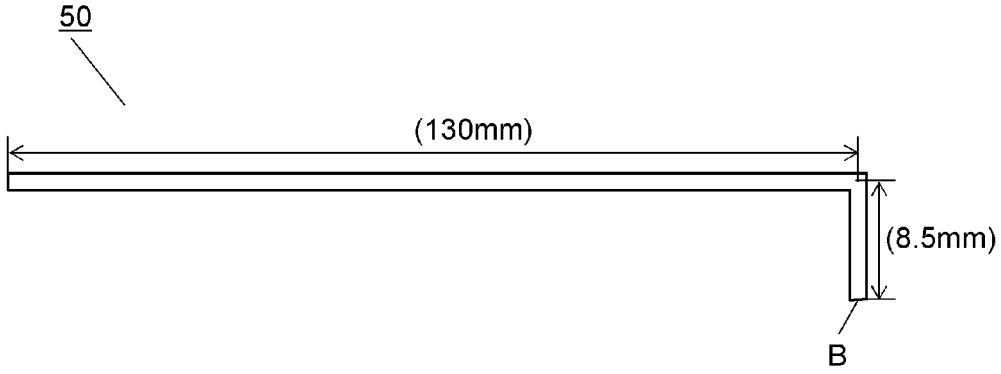
FIG. 7 is a view showing a configuration of a front antenna.

FIG. 7 is a view showing a configuration of the front antenna 50 attached to the main body 30. The front antenna 50 is attached, in the main body 30, to the vicinity of the end portion thereof opposite with the end portion to which the antenna device 10 is attached. In this exemplary embodiment, the front antenna 50 is a monopole antenna. The front antenna 50 may be located, when viewed from the front, on a right side in a lower portion of the LCD 20 of the display device 1. The front antenna 50 may be provided inside of the main body 30 around the vicinity of a front surface thereof. The front antenna 50 is extended mainly in parallel to the x-axis. More specifically, the front antenna 50 is extended by 8.5 mm in the negative direction of the y-axis from a power feeding end B located in the inside of the main body 30, and is bent by 90 degrees in the negative direction of the x-axis. Then, the front antenna 50 is extended by 130 mm in the negative direction of the x-axis. A power feeding section for the front antenna 50 is not shown; however, is provided in the inside of the main body 30.

The description has been made above of the configuration of the display device 1 according to this exemplary embodiment. Next, a description is made of functions of the display device 1.

FIGS. 8A to D are views showing radiation patterns of horizontal polarizations of the respective antennas when the display device 1 is viewed from the positive direction side of the z-axis. Note that, for each of the radiation patterns of FIGS. 8A to D, the case is shown, when an angle made by the antenna device 10 with the z-axis is 30 degrees ($\theta=30°$ in FIG. 1). Moreover, a center of each diagram of FIGS. 8A to D coincides with a center of the display device 1.

Figure 8A:
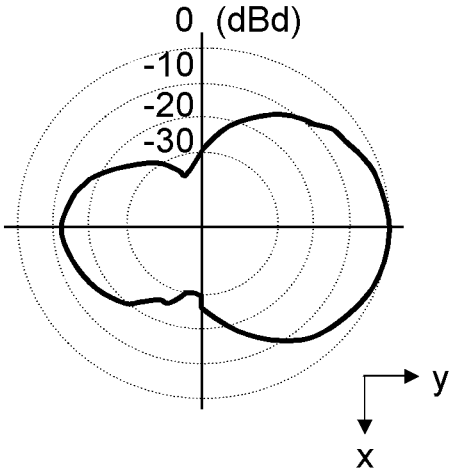
FIG. 8A is a diagram showing a radiation pattern of a horizontal polarization of the dipole antenna.

FIG. 8A shows a radiation pattern of the dipole antenna 110. The dipole antenna 110 has a high gain in a back surface direction (positive orientation of the y-axis) of the display device 1. This is because the metal frame of the LCD 20 disposed more on a front surface side than the antenna device 10 functions as a reflector. By using the metal frame of the LCD 20, the display device 1 reflects, to the back surface direction, a radio wave of the front surface direction (negative orientation of the y-axis) in the dipole antenna 110, thereby increasing the gain to the back surface direction. Moreover, the radiation pattern of the dipole antenna 110 has a minimum (minimum of gain) substantially in the positive and negative directions of the x-axis, that is, substantially in the right and left direction.

Figure 8B:
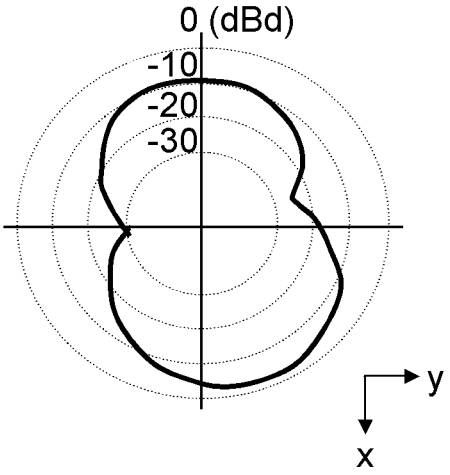
FIG. 8B is a diagram showing a radiation pattern of a horizontal polarization of the first monopole antenna.

FIG. 8B shows a radiation pattern of the first monopole antenna 120. The first monopole antenna 120 has a high gain in a substantially right direction (positive orientation of the x-axis) of the display device 1 when viewed from the front. This is because the first portions 1111 and 1121 of the dipole antenna 110 function as reflectors. By using the first portions 1111 and 1121 of the dipole antenna 110, the display device 1 increases the gain to the right direction (positive direction of the x-axis) in the first monopole antenna 120. The radiation pattern of the first monopole antenna 120 has a minimum substantially in the positive and negative directions of the y-axis, that is, substantially in a fore and aft direction.

Figure 8C:
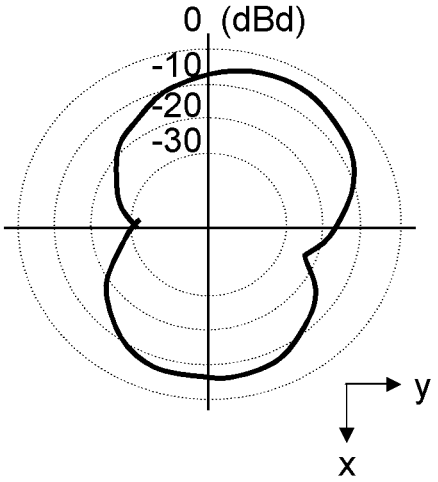
FIG. 8C is a diagram showing a radiation pattern of a horizontal polarization of the second monopole antenna.

FIG. 8C shows a radiation pattern of the second monopole antenna 130. The second monopole antenna 130 has a high gain in a substantially left direction (negative orientation of the x-axis) of the display device 1 when viewed from the front. This is because the first portions 1111 and 1121 of the dipole antenna 110 function as reflectors. By using the first portions 1111 and 1121 of the dipole antenna 110, the display device 1 increases the gain to the left direction (negative direction of the x-axis) in the second monopole antenna 130. The radiation pattern of the second monopole antenna 130 has a minimum substantially in the positive and negative directions of the y-axis, that is, substantially in the fore and aft direction.

Figure 8D:
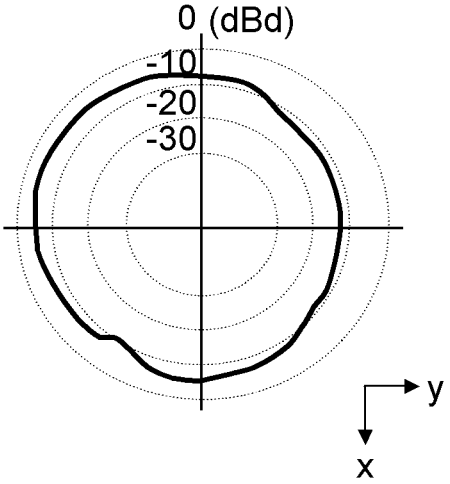
FIG. 8D is a diagram showing a radiation pattern of a horizontal polarization of an entire surface antenna.

FIG. 8D shows a radiation pattern of the front antenna 50. The front antenna 50 has a high gain in the front surface direction (negative orientation of the y-axis) of the display device 1. This is owing to an influence of structures in the main body 30 located on the back surface side of the front antenna 50, and of arrangement of the LCD 20. By using the main body 30 and the LCD 20, the display device 1 increases the gain to the front surface direction in the front antenna 50.

As described above, in the display device 1, the dipole antenna 110 has strong directivity in the positive orientation of the y-axis, and the front antenna 50 has strong directivity in the negative direction of the y-axis. Therefore, coupling of the dipole antenna 110 and the front antenna 50 can be reduced. As a result, the antenna device 10 can suppress reduction of the gain, which is caused by the coupling of the dipole antenna 110 and the front antenna 50.

Moreover, in the display device 1, the first monopole antenna 120 has strong directivity in the positive orientation of the x-axis, and the second monopole antenna 130 has strong directivity in the negative orientation of the x-axis. Therefore, coupling of the first monopole antenna 120 and the second monopole antenna 130 can be reduced. As a result, the antenna device 10 can suppress reduction of the gain, which is caused by the coupling of the first monopole antenna 120 and the second monopole antenna 130.

Furthermore, in the display device 1, the dipole antenna 110 has the minimum in the left and right direction (respective positive and negative orientations of the x-axis). Therefore, the coupling of the dipole antenna 110 and the first monopole antenna 120 and the coupling of the dipole antenna 110 and the second monopole antenna 130 can be reduced. As a result, the antenna device 10 can suppress reduction of the gain, which is caused by the coupling of the respective antennas.

As described above, the antenna device 10 included in the display device 1 according to a first exemplary embodiment includes: the power feeding section 150; and the board 140 on which there are formed the dipole antenna 110 having left and right first and second elements 111 and 112, the first monopole antenna 120, and the second monopole antenna 130. The dipole antenna 110 includes: the first portions 1111 and 1121 in which left and right first and second elements 111 and 112 are extended from a connection point of the power feeding section 150 in a state where left and right first and second elements 111 and 112 face each other; and the second portions 1112 and 1122 in which left and right first and second elements 111 and 112 are extended from the first portions 1111 and 1121 separately to left and right sides. The first monopole antenna 120 is connected to the power feeding section 150, and is extended toward the second portion 1112 of left first element 111 in the dipole antenna 110. The second monopole antenna 130 is connected to the power feeding section 150, and is extended toward the second portion 1122 of right second element 112 in the dipole antenna 110.

In such a way, the antenna device 10 can be provided, which is capable of arranging the plurality of antennas having the same frequency band close to one another in a loosely coupling manner.

Moreover, in the dipole antenna 110 of the antenna device 10, the first portions 1111 and 1121 are extended in the first direction. Then, the second portions 1112 and 1122 are extended reverse to each other in the second direction perpendicular to the first direction. Each of the first monopole antenna 120 and the second monopole antenna 130 has the portion, which is formed at a position symmetric to the other while interposing the first portions 1111 and 1121 of the dipole antenna 110 therebetween and is extended in first direction.

In such a way, the antenna device 10 can be provided, which is capable of arranging the plurality of antennas having the same frequency band closer to one another in a more loosely coupling manner.

Moreover, the power feeding section 150 of the antenna device 10 includes: the ground for dipole (the ground area 151) corresponding to the dipole antenna 110; the ground for first monopole (the ground area 152) corresponding to the first monopole antenna 120; and the ground for second monopole (the ground area 153) corresponding to the second monopole antenna 130, all of which are formed on the single board separately from one another.

In such a way, vertical polarizations of the first monopole antenna 120 and the second monopole antenna 130 can be strengthened. As a specific example, gains of the vertical polarizations can be enhanced by approximately 4 dB to the maximum between the case where respective the ground areas 151 to 153 are connected to one another and the case where respective the ground areas 151 to 153 are separated from one another as in this exemplary embodiment.

Moreover, the tip portions in the second portions 1112 and 1122 of the dipole antenna 110 are folded in opposite directions to the extended directions thereof. In particular, in this exemplary embodiment, the tip portions of the second portions 1112 and 1122 are folded in the opposite directions to the extended directions so that open ends thereof can face the first direction, and form a loop shape.

In such a way, a service band on a low frequency side of the dipole antenna 110 can be expanded. In other words, a gain on the low frequency side of the dipole antenna 110 can be increased. As a specific example, the entangled portions 1112*a* and 1122*a* are formed in the dipole antenna 110, whereby a gain around the 473 MHz band can be increased by approximately 0.5 dB.

Moreover, the tip portion of at least one of the first monopole antenna 120 and the second monopole antenna 130 is folded in an opposite direction to the extended direction thereof. In particular, in this exemplary embodiment, the tip portion of at least one of the first monopole antenna 120 and the second monopole antenna 130 is folded in the opposite direction to the extended direction so that an open end thereof can face the second direction, and form a loop shape.

In general, as means for expanding the service band of the monopole antenna, there is known a technology, which is called top load, for widening a width of an element tip portion. When this top load is applied to the antenna device 10, coupling of the monopole antenna with the dipole antenna 110 is increased, and it is apprehended that performance of the dipole antenna 110 may be deteriorated. The entangled portions 1221 and 1321 are provided as in this exemplary embodiment, whereby service bands on a low frequency side of the first monopole antenna 120 and the second monopole antenna 130 can be expanded while reducing the performance deterioration of the dipole antenna 110. As a specific example, the entangled portions 1221 and 1321 are formed in the first monopole antenna 120 and the second monopole antenna 130, whereby the gain around 473 MHz can be increased by approximately 1 dB without the performance deterioration of the dipole antenna 110.

Moreover, the antenna device 10 further includes the passive element 160 that is formed on the board 140 and is provided on the opposite side with the power feeding section 150 when viewed from the second portions 1112 and 1122 of the dipole antenna 110. In particular, in this exemplary embodiment, the passive element 160 is extended in the second direction so as to be parallel to the second portions 1112 and 1122.

In such a way, in a relatively high service band, the dipole antenna 110 and the passive element 160 are coupled to each other, and the passive element 160 resonates therewith, whereby a service band on a high frequency side of the dipole antenna 110 can be expanded.

Moreover, both ends of the passive element 160 are bent in the orientation going toward the second portions 1112 and 1122 of the dipole antenna 110. Then, the second portions 1112 and 1122 of the dipole antenna 110 have the bent portions 1112*b* and 1122*b* at some midpoints therein, and are formed so that both ends of the passive element 160 can be located in the region surrounded by the bent portions.

In order to form the antenna device 10 into a shape as compact as possible, the bent portions 1112*b* and 1122*b* are provided at some midpoints in the dipole antenna 110. However, when such bent portions are provided, a distance between the dipole antenna 110 and the passive element 160 is changed depending on an element position. In such a case, it is apprehended that performance of the passive element 160 may be deteriorated. In this exemplary embodiment, the bent portions 1112*b* and 1122*b* are formed so that both end portions of the passive element 160 can be located in the region surrounded by the bent portions 1112*b* and 1122*b* of the dipole antenna 110. In such a way, the distance between the dipole antenna 110 and the passive element 160 can be made constant. As a result, effects of the passive element 160 can be prevented from being deteriorated.

Moreover, the display device 1 includes: the antenna device 10; the main body 30 having the electric circuit that converts, into the electric signal, the radio wave received by the antenna device 10; and the LCD 20 that receives the electric signal coming from the main body 30 and displays the image. In particular, in this exemplary embodiment, in the dipole antenna 110 in the antenna device 10, the first portions 1111 and 1121 are extended in the first direction. Then, the antenna device 10 is supported so as to be rotatably erected on the upper surface side of the main body 30. Moreover, the LCD 20 is supported so that the image display surface thereof can face the opposite side with the antenna device 10. Furthermore, in the antenna device 10, the second direction perpendicular to the first direction is parallel to the upper surface of the main body 30 and the image display surface.

In such a way, a component, which goes toward the front surface side from the dipole antenna 110, is reflected on the back surface of the LCD 20, whereby the gain in the back surface direction of the display device 1 can be enhanced.

Moreover, the display device 1 includes the front antenna 50 provided on an end portion side in the main body 30, on which the LCD 20 is located. The front antenna 50 is a monopole antenna extended in the second direction.

In such a way, the gain with respect to the front surface side direction of the display device 1 can be enhanced.

Moreover, in the display device 1, when the image display screen side of the LCD 20 is defined as the front surface direction of the display device 1, the front antenna 50 has the maximum gain with respect to the front surface direction of the display device 1, the dipole antenna 110 has the maximum gain with respect to the back surface direction of the display device 1, and each of the first monopole antenna 120 and the second monopole antenna 130 has the maximum gain with respect to the left and right direction of the display device 1.

In such a way, the display device, which has high sensitivity with respect to every orientation, can be configured by using the antenna device capable of arranging the plurality of antennas having the same frequency band close to one another in a loosely coupling manner.

The above-mentioned exemplary embodiment is an example of the instant application. Needless to say, the instant application is not limited to the above-described exemplary embodiment, is modifiable in various ways, and such a variety of modifications are also incorporated in the scope of the instant application.

INDUSTRIAL APPLICABILITY

The instant application is suitable for sensitivity enhancement of an instrument having a plurality of antennas.

REFERENCE MARKS IN THE DRAWINGS

1 display device
10 antenna device
110 dipole antenna
111 first element
112 second element
1111, 1121 first portion
1112, 1122 second portion
1112*a*, 1122*a*, 1221, 1321 entangled portion
1112*b*, 1122*b*, 1211, 1311 bent portion
120 first monopole antenna
121 first portion
122 second portion
130 second monopole antenna
131 first portion
132 second portion
140 board
150 power feeding section
151, 152, 153 ground area
160 passive element
20 LCD
30 main body
40 support member
50 front antenna

The invention claimed is:

1. An antenna device, comprising:
an insulating board;
a power feeding section;
a dipole antenna disposed on the insulating board and configured to receive electric power from the power feeding section;
a first monopole antenna disposed on the insulating board and configured to receive electric power from the power feeding section; and
a second monopole antenna disposed on the insulating board and configured to receive electric power from the power feeding section, wherein:
the dipole antenna includes left and right elements connected to the power feeding section, and the left and right elements have:
first portions extending from the power feeding section in a state of facing each other; and
second portions extending from the first portions separately to left and right sides,
the first monopole antenna connects to the power feeding section and extends toward the second portion of the left element in the dipole antenna,
the second monopole antenna connects to the power feeding section and extends toward the second portion of the right element of the dipole antenna, and
the dipole antenna including the first portions and the second portions, the first monopole antenna, and the second monopole antenna are disposed on a same plane.

2. The antenna device of claim 1, wherein:
the power feeding section includes:
a dipole ground for the dipole antenna;
a first monopole ground for the first monopole antenna; and
a second monopole ground for the second monopole antenna, and
the dipole grounds, the first monopole ground, and the second monopole ground are formed on a single board separately from one another.

3. The antenna device of claim 1, wherein
in the dipole antenna, tip portions in the second portions are folded in opposite directions to extending directions thereof, and have a loop shape.

4. The antenna device of claim 1, wherein
a tip portion of at least one of the first monopole antenna and the second monopole antenna is folded in an opposite direction to an extending direction thereof, and has a loop shape.

5. The antenna device of claim 1, wherein
a passive element is provided on the insulating board, and the passive element is disposed to be parallel to the second portions of the left and right elements of the dipole antenna.

6. A display device, comprising:
an antenna device including an insulating board, a power feeding section, a dipole antenna, a first monopole antenna, and a second monopole antenna, the dipole, first monopole and second monopole antennas being disposed on the insulating board and configured to receive electric power from the power feeding section;

a main body housing an electric circuit configured to convert, into an electric signal, a radio wave received by the antenna device; and a display configured to receive the electric signal from the main body and display an image, wherein:

the dipole antenna of the antenna device includes left and right elements connected to the power feeding section, and the left and right elements have:

first portions extending from the power feeding section in a state of facing each other; and second portions extending from the first portions separately to left and right sides, the first monopole antenna connects to the power feeding section, and extends toward the second portion of the left element of the dipole antenna, the second monopole antenna connects to the power feeding section extends toward the second portion of the right element of the dipole antenna, and the dipole antenna including the first portions and the second portions, the first onopole antenna, and the second monopole antenna are disposed on a same plane.

7. The display device of claim 6, wherein, in the dipole antenna, tip portions in the second portions are folded in an opposite direction to an extending direction thereof, and have a loop shape, and a tip portion of at least one of the first monopole antenna and the second monopole antenna is folded in an opposite direction to an extending direction thereof, and has a loop shape.

8. The display device of claim 6, wherein a passive element is provided on the insulating board, and the passive element is disposed to be parallel to the second portions of the left and right elements of the dipole antenna.

* * * * *